United States Patent [19]

Okita

[11] Patent Number: 5,067,919

[45] Date of Patent: Nov. 26, 1991

[54] TILTING/TRIMMING SYSTEM FOR MARINE PROPULSION UNIT

[75] Inventor: Ryozo Okita, Hamamatsu, Japan

[73] Assignee: Sanshin Industries Co., Ltd., Hamamatsu, Japan

[21] Appl. No.: 420,588

[22] Filed: Oct. 12, 1989

[30] Foreign Application Priority Data

Oct. 12, 1988 [JP] Japan ..... 63-256745

[51] Int. Cl.[5] ..... B63H 21/26

[52] U.S. Cl. ..... 440/61

[58] Field of Search ..... 440/53, 61, 84

[56] References Cited

U.S. PATENT DOCUMENTS

| | | | |
|---|---|---|---|
| 3,799,104 | 3/1974 | Kurling . | |
| 3,842,789 | 10/1974 | Bergstedt . | |
| 4,753,618 | 6/1988 | Entringer | 440/84 |
| 4,759,731 | 7/1988 | Uchida et al. | 440/84 |
| 4,801,282 | 1/1989 | Ogawa et al. | 440/84 |
| 4,898,563 | 2/1990 | Torigai et al. | 440/61 |

FOREIGN PATENT DOCUMENTS 60-234096 11/1985 Japan .

*Primary Examiner*—Sherman Basinger

*Assistant Examiner*—Stephen P. Avila

[57] ABSTRACT

A magnetically operated selector valve is used in the first two embodiments of this invention for controlling the flow of hydraulic fluid through a hydraulic tilt and trim system of a marine outboard drive unit to achieve quick tilting up of the drive unit and slow trimming movement of the drive unit between a plurality of trim positions. In each of these embodiments the selector valve is linked to a gear throttle control mechanism and a manual switch used to operate the pump. In the first embodiment, the system includes two fluid motors, preferably of the piston -cylinder type, interposed between the marine vessel and the drive unit for adjusting the tilt and trim of the unit. A reversible fluid pump is used to power the fluid motors and communicates with the fluid motors by way of conduits and hoses. To achieve slow trimming movement of the drive unit, the valve is adjusted so that the pump delivers hydraulic fluid to one fluid chamber of each fluid motor simultaneously while fluid in the other chamber of each fluid motor is discharged back to the pump. In the quick tilt-up mode, the valve is adjusted so that the pump delivers twice the hydraulic fluid to only one of the fluid motors.

11 Claims, 7 Drawing Sheets

TILTING/TRIMMING SYSTEM FOR MARINE PROPULSION UNIT

BACKGROUND OF THE INVENTION

The invention relates to a tilting and trimming system for an outboard drive unit of a marine vessel. More particularly, the invention relates to an improved hydraulically operated tilting and trimming system adapted for quick tilting up of the drive unit and slow trimming of the drive unit.

As is well known, a variety of hydraulic systems have been employed for achieving tilt and trim movement of a marine outboard drive unit. These system typically include a reciprocating hydraulic or fluid motor, which is interposed between the transom of the marine vessel and the drive unit for adjusting the tilt and the trim of the outboard drive unit in response to extension and contraction of the fluid motor. The fluid motor is powered by a fluid system that is normally contained within the hull of the marine vessel and may include a reversible electric motor and a reversible fluid pump. In connection with such systems, it is normal practice to include a pressure relief valve or valves in the hydraulic circuitry to the fluid motors so as to relieve pressure in the system and protect the system and drive unit from damage in the event the drive unit collides with a submerged or floating obstacle.

Previous tilt and trim systems have been arranged to provide for both quick tilting movement and slow trimming movement of the drive unit. Some of these systems utilize a manual valve coupled to the gear control mechanism of the drive unit to achieve tilting and trimming by shifting the gears of the drive unit. An example of such a system is set forth in U.S. Pat. No. 3,842,789. Other systems utilize a plurality of pistons and a multitude of valves interconnected within the hydraulic circuitry to achieve tilting and trimming functions. Examples of these systems are set forth in U.S. Pat. No. 3,799,104 and Japanese patent 60-234096.

Unlike previous systems arranged to provide both quick tilting and slow trimming of an outboard drive unit, two embodiments of the invention utilize a magnetically operated selector valve electrically linked to the gear throttle control mechanism and a manual switch for effecting quick tilting up movement and slow trimming movement of the drive unit. A third embodiment of the present invention utilizes a means for controlling the voltage applied to the motor to achieve quick tilting up movement and slow trimming movement instead of a selector valve. Fourth and fifth embodiments of the invention utilize a tilt fluid motor for performing tilting operation and a pair of trim fluid motors for trimming the drive unit. The position of the selector valve is controlled in these embodiments by a gear-throttle control or engine speed, and a manual switch.

SUMMARY OF THE INVENTION

A first embodiment of this invention includes a hydraulic tilt and trim system for an outboard drive unit mounted on the transom of a marine vessel. The system includes first and second fluid motors extendably connecting the drive unit and transom or stationary part of the drive unit. Each fluid motor has a cylinder housing and a moveable member, typically a piston rod and a piston, which defines a pair of fluid chambers. In accordance with the invention, the system includes a pump for delivering hydraulic fluid from a reservoir to the fluid motors. The pump fluidly communicates with the fluid motors by way of conduits and hoses and is driven by an electric motor. This system further includes a magnetically operated selector valve adjustable between a first and second position by the gear-throttle control mechanism and a manual switch.

The selector valve controls the flow of hydraulic fluid from the pump to the fluid motors. When the valve is adjusted for slow trimming, the pump delivers hydraulic fluid simultaneously to both of said fluid motors. When the valve is adjusted for quick tilting-up, the pump delivers hydraulic fluid to only one of said fluid motors.

A second embodiment of the invention utilizes at least one and preferably two fluid motors. In this embodiment, the selector valve controls the flow of hydraulic fluid through the system as follows. In the slow trimming position, the valve permits fluid to flow to only one of the chambers of each fluid motor. In the quick tilting-up position, the valve permits hydraulic fluid to flow to both of the chambers of one fluid motor simultaneously.

A third embodiment of the invention utilizes means for controlling the voltage applied to the electric motor used to drive the pump, instead of a selector valve, to effect slow trimming movement and quick tilting-up movement of the drive unit. As with the previous two embodiments, the gear-throttle control mechanism and manual switch are used to control the position of the selector valve.

Fourth and fifth embodiments of the invention use two trim fluid motors and a single tilt fluid motor to achieve tilting and trimming. The flow of hydraulic fluid from the pump to the fluid motors is controlled by a magnetically operated selector valve. In the fourth embodiment, the position of the valve is by the gear-throttle control mechanism and manual switch. The position of the controlled valve is controlled in the fifth embodiment in accordance with the engine speed.

DETAILED DESCRIPTION OF THE PREFERRED EMBODIMENTS

Figure 1:
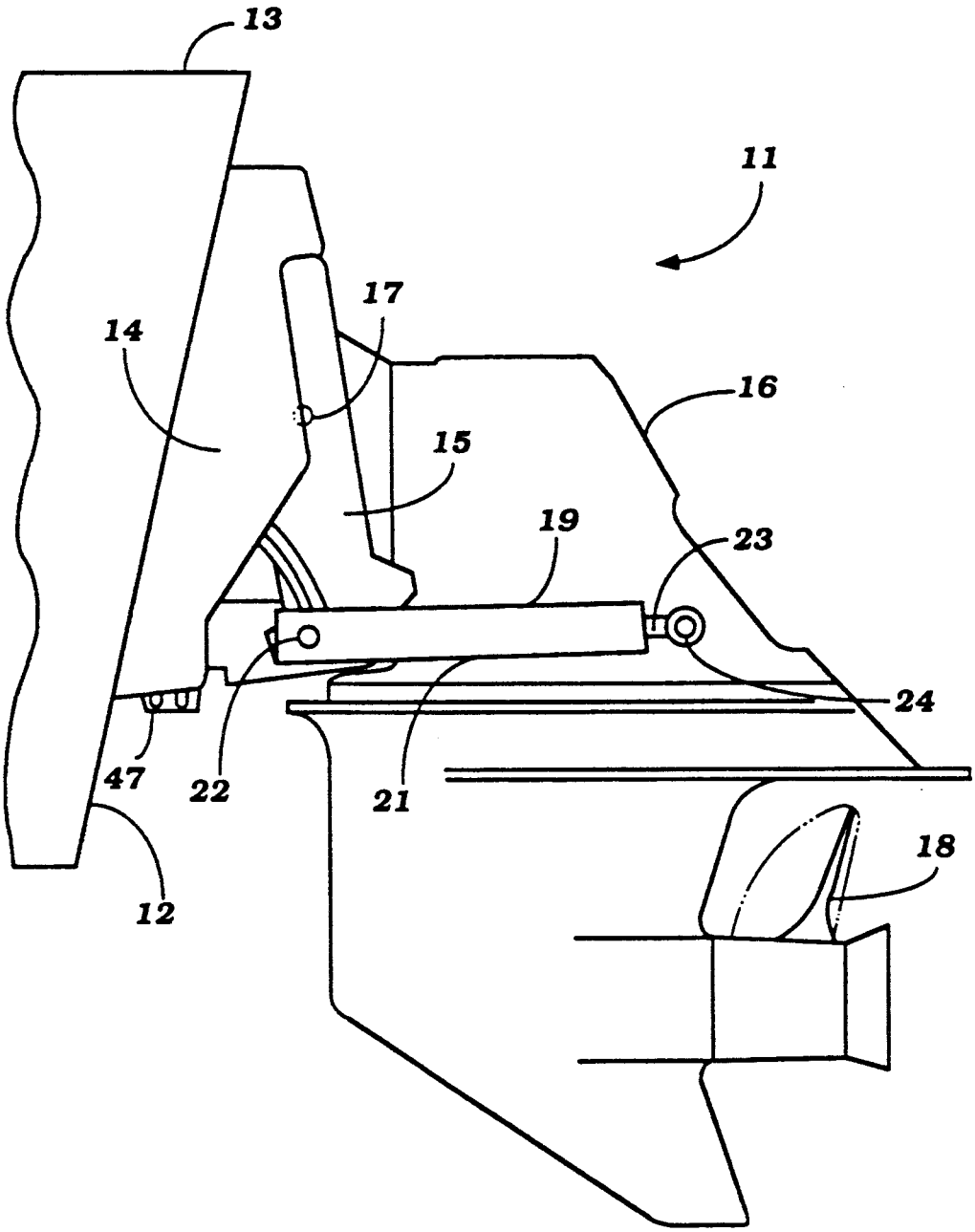
FIG. 1 is a partial side elevational view of a marine vessel having an outboard drive unit constructed in accordance with the invention.

Referring to FIG. 1, an outboard drive unit of an inboard/outboard drive assembly is indicated generally by the reference numeral 11 and is depicted as being attached to the transom 12 of the hull 13 of a marine vessel. The outboard drive unit 11 includes a gimbal housing 14 that is affixed to the transom 12 and which supports a gimbal ring 15 for steering movement about a vertically extending steering axis. An outboard drive housing 16 is pivotally connected to the gimbal ring 15 by means of a pivot pin 17 for tilt and trim movement.

An internal combustion engine (not shown) is mounted within the hull 13 and drives a propeller 18 of the outboard drive unit 11 through a conventional forward, neutral, reverse transmission (not shown). The construction of the outboard drive unit 11 per se, is not necessary to understand the invention and, as will become apparent, the invention is adaptable for an outboard motor or the outboard stern drive portion of an inboard/outboard engine system which are collectively called "outboard drive units" in the specification and claims.

The invention deals primarily with the hydraulic system for operating the tilt and trim of the outboard drive unit 11. This system comprises linear type fluid motors indicated generally by reference numeral 19 in FIG. 1 and more specifically as 19A and 19B respectively in FIGS. 2 through 4 and 87 and 88 respectively in FIGS. 5 through 7. Each fluid motor 19A and 19B includes a cylinder housing 21A and 21B respectively that is journaled at one end on the gimbal ring 15 by means of a pivot pin 22. Each fluid motor 19A and 19B further includes a piston rod 23A and 23B respectively that extends from the cylinder housing 21A or 21B and is pivotally connected to the side of the outboard drive housing 16 by a pivot pin 24.

Figure 2:
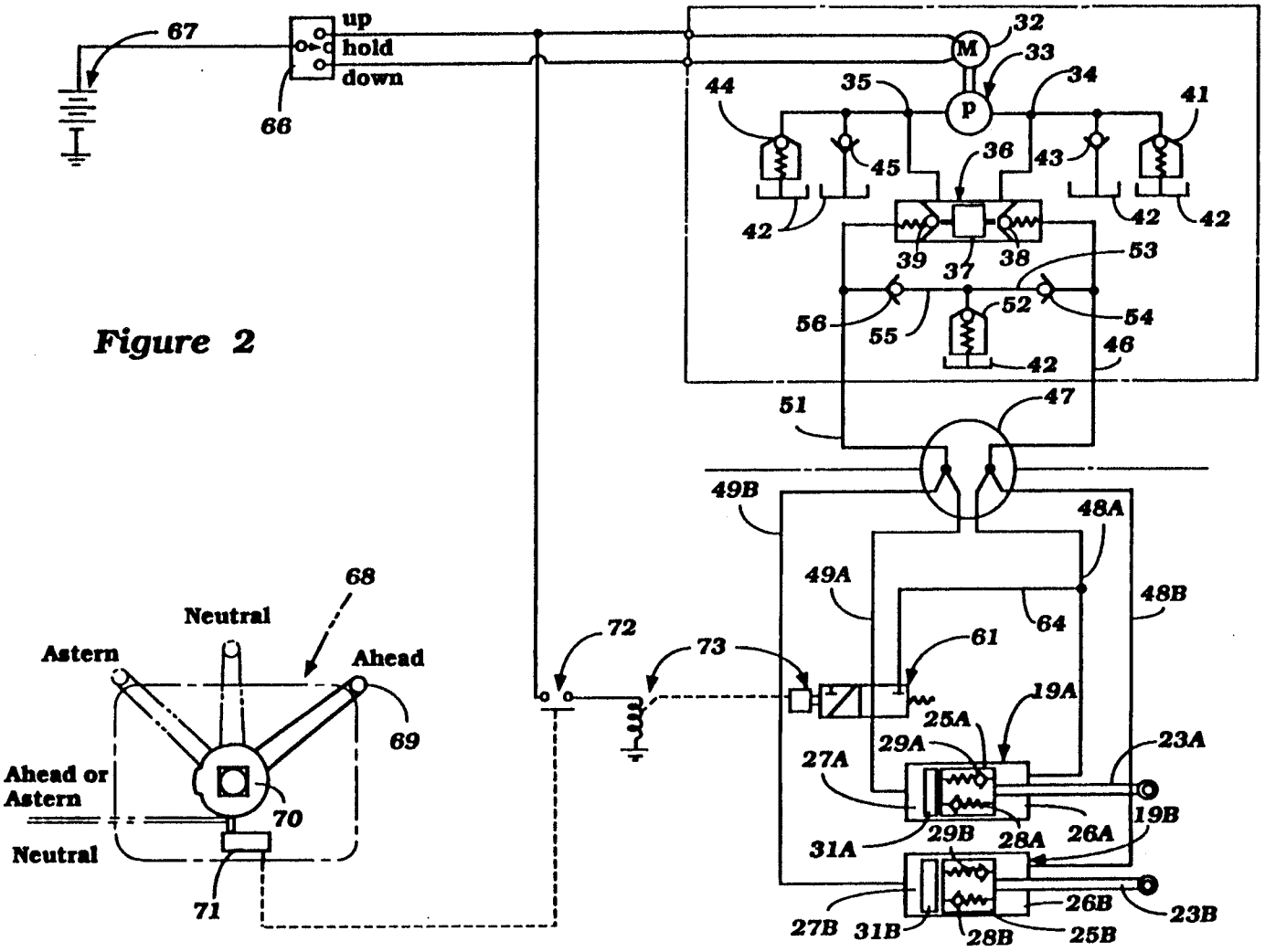
FIG. 2 is a schematic hydraulic circuit diagram with a magnetically operated selector valve in the low speed trimming mode showing a first embodiment of the invention.

FIG. 2 shows a first embodiment of the present invention, including the hydraulic circuitry for operating the system, wherein the internal details of the fluid motors 19A and 19B are depicted. Each fluid motor 19A and 19B includes a piston 25A and 25B respectively which is connected to the appropriate piston rod 23A or 23B in a known manner. The pistons 25A and 25B divide the cylinder housings 21A and 21B respectively into first fluid chambers 26A and 26B respectively and second fluid chambers 27A and 27B respectively. Pressure responsive absorber valves 28A and 28B permit flow from chambers 26A and 26B respectively to chambers 27A and 27B respectively in the event of impact with an underwater obstacle. Pressure responsive check valves 29A and 29B permit return flow once the obstacle has teen cleared. Floating pistons 31A and 31B are contained within chambers 27A and 27B respectively and serve to retain the outboard drive housing 16 in a trim adjusted position.

Contained within the hull 13 of the marine vessel 11 is the system for selectively pressuring the chambers 26A, 26B, 27A or 27B to achieve power trim and tilt movement. This system includes a reversible electric motor 32 that drives a reversible fluid pump 33. The pump 33 has a pair of ports 34 and 35 that serve selectively as pressure or return ports depending on ether the outboard drive unit 11 is being tilted or trimmed up or trimmed down.

The ports 34 and 35 communicate with a shuttle valve assembly, indicated generally by the reference numeral 36. This assembly includes a shuttle piston 37 and a pair of check valves 38 and 39. The shuttle piston 37 has projections that are adapted to unseat the check valves 38 or 39 under an operation as will be described.

There is provided a pressure responsive relief valve 41 in communication with port 34 that permits flow back to a reservoir 42 in the event a high pressure condition exists in the pumping system. In a like manner a check valve 43 permits return flow to the system for make up purposes. A pressure relief valve 44 communicates the port 35 with the reservoir 42. A check valve 45 permits fluid to flow from the reservoir 42 to the port 35 for make up purposes.

The system further includes a magnetically operated selector valve 61 and a manually operated switch 66 in circuit with a battery 67 and the motor 32 for operating the motor 32 and pump 33.

The magnetically operated selector valve 61 includes a solenoid and a solenoid winding 73 shown displaced in FIG. 2. The selector valve 61 is electrically linked to a gear-throttle control mechanism 68 and the manually operated switch 66, which are used to adjust the selector valve 61 between a first and second position for slow trimming and quick tilting of the drive unit 11. The control mechanism 68 includes an adjustable control lever 69 for operating the drive unit 11 in forward, reverse or neutral, and a casing member 70 secured to the control lever 69 at its pivot point. Movement of the control lever 69 between the forward, reverse and neutral positions effects movement of the magnetically operated selector valve 61 as hereinafter described. The control mechanism 68 is linked to the selector valve 61 through a limit switch 71 which has a pair of electrical contacts 72, shown displaced in FIG. 2, for opening and closing the circuit between the switch 66 and the selector valve 61. The position of the switch 71 is controlled by the position of the control lever 69.

When the control lever 69 is moved to a forward or reverse position, a cam on the casing member 70 releases the switch 71 so that the circuit between the switch 66 and selector valve 61 is open as shown in FIG. 2. When the control lever 69 is in forward or reverse, the selector valve 61 is in the first or trim adjusted position. The system is now arranged for slow trimming of the drive unit 11.

To trim up the drive unit 11, the switch 66 is adjusted to the "up" position so that current flows from the battery 67 to drive the motor 32 and pump 33 so as to pressurize port 35. To trim down the drive unit 11, the switch 66 is adjusted to the "down" position to drive the motor 32 and pump 33 in the opposite direction to pressurize port 34. The switch 66 also includes a "hold" position wherein the circuit between the battery 67 and the motor 32 is open so that no current flows to the motor 32. The "hold" position is used to maintain the drive unit 11 in its present trim adjusted position.

FIG. 2 illustrates the hydraulic circuitry for operating the system in the low speed trimming mode. When the motor 32 and pump 33 are operated so as to deliver hydraulic fluid to and thereby pressurize port 34, the pressure in the shuttle valve assembly 36 will effect movement of the shuttle piston 37 to the left to open the check valve 39. The pressure in the shuttle valve assembly 36 also causes the check valve 38 to unseat and open communication with a first conduit 46 that extends to a distributor housing 47 that is mounted on the gimbal housing 14 of the outboard drive unit 11. The distributor housing 47 communicates the first conduit 46 with a pair of flexible conduits 48A and 48B that extend to chambers 26A and 26B respectively of fluid motors 19A and 19B. This will effect movement of the pistons 25A and 25B to the left so as to cause trim down operation.

During this operation, fluid is discharged from the chambers 27A and 27B through flexible hoses 49A and 49B respectively to the distributor housing 47 for the return to the shuttle valve 36 through a second conduit 51. The fluid returns through the open check valve 39 to port 35 so as to provide return fluid for the system. The magnetically operated selector valve 61 prevents fluid flow from flexible conduit 48A to flexible hose 49A through a bypass conduit 64 when the valve 61 is in the first position, as shown in FIG. 2.

For trim-up operation, the motor 32 and pump 33 are driven in the opposite direction so as to pressurize port 35 and cause the shuttle piston 37 to move to the right opening the check valve 38 so that the port 34 acts as a return port. The fluid pressure in the shuttle valve assembly 36 will open the check valve 39 and then flow through the second conduit 51 and flexible hoses 49A and 49B to pressurize the chambers 27A and 27B of fluid motors 19A and 19B and cause trim up movement.

To operate the system in the high speed tilt up mode, the control lever 69 of the gear-throttle control mechanism 68 is moved to the neutral position. When the control lever 69 is in that position, the cam on casing member 70 depresses switch 71 so that its contacts close the circuit between the switch 66 and the selector valve 61. To achieve quick tilt up of the drive unit 11, the switch 66 is moved to the "up" position to drive the motor 32 and pump 33 so as to pressurize port 35 and to close the circuit between the battery 67 and the solenoid winding 73 of the selector valve 61. Current flows from the battery 67 through switches 66 and 71 to energize the solenoid winding 73 causing the selector valve 61 to move to its second or tilt adjusted position.

The hydraulic fluid flows into the shuttle valve assembly 36 to effect movement of the shuttle piston 37 to the right causing check valve 38 to open. The pressure in the shuttle valve assembly 36 also causes check valve 39 to unseat and open communication with the second conduit 51. Hydraulic fluid then flows through the distributor housing 47 into flexible hoses 49A and 49B.

At this point the tilting up operating differs from the trimming up operation. In the tilting up operation, the selector valve 61 prevents flow of hydraulic fluid from flexible hose 49A to chamber 27A when it is in its second position. This causes the hydraulic fluid in flexible hose 49A to "back-up" so that the hydraulic fluid delivered by pump 33 flows through flexible hose 49B thereby doubling the fluid volume delivered to chamber 27B, as compared with the fluid delivered to chamber 27B during trim-up operation. Thus, when the selector valve 61 is in the second position, the pump 33 delivers fluid only to chamber 27B. Since the fluid delivered to chamber 27B is approximately twice that which is delivered during slow trimming operation, a quick outward movement of the piston rod 23B, and thus quick tilting up of the drive unit 11 is achieved.

The hydraulic system further includes a relief valve 52 and a manual bypass valve assembly positioned in the conduit system so as to relieve the hydraulic pressure in the event an impact is received on the drive housing 16 that is greater than that which may be relieved through the pressure responsive valves 28A, 28B, 29A or 29B. The valve 52 is positioned in the conduit system so that it can relieve impact loads in either direction. This bypass valve assembly includes a conduit 53 that extends from the first conduit 46 to the relief valve 52. The conduit 53 includes check valve 54 that permits flow from the first conduit 46 to the conduit 53 and relief valve 52 but not flow in the opposite direction. A conduit 55 communicates the second conduit 51 with the valve 52. A check valve 56 is provided that permits flow from the second conduit 51 into the conduit 55 and relief valve 52 but not flow in the reverse direction. Thus, high pressure in any of the chambers 26A, 26B, 27A or 27B of the fluid motors 19A and 19B can he relieved through the single relief valve 52.

Figure 3:
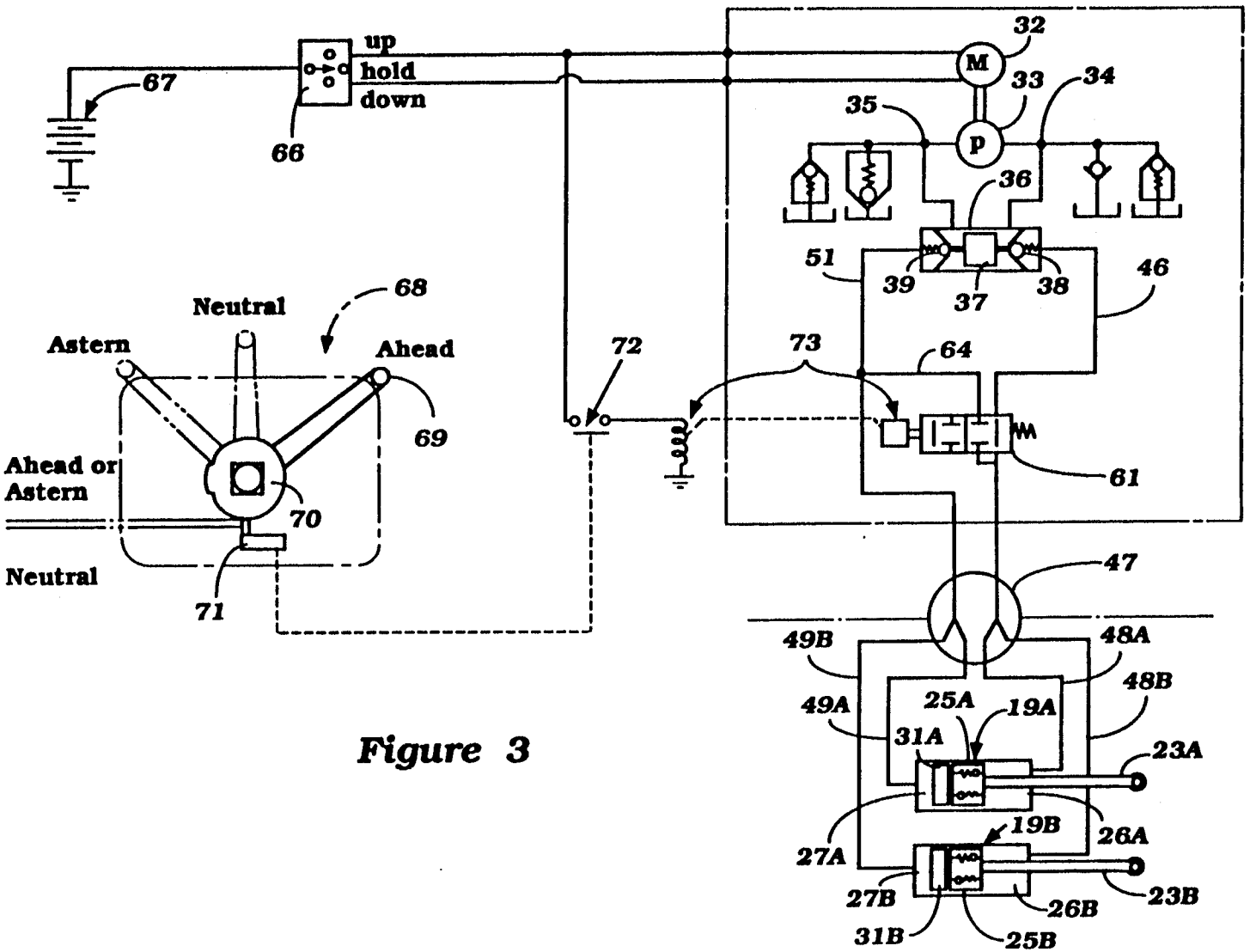
FIG. 3 is a schematic hydraulic circuit diagram showing the low speed trimming mode of a second embodiment of the invention, wherein the magnetically operated selector valve is positioned between the motor and the distributor housing.

Referring now to FIG. 3, the magnetically operated selector valve 61 is positioned on the motor 32 and pump 33 side of the distributor housing 47 and controls the flow of hydraulic fluid through first conduit 46 and the bypass conduit 64 to effect quick tilting-up and slow trimming of the drive unit 11 as hereinafter described. As illustrated in FIG. 3, the selector valve 61 is its first or trim adjusted position. The position of the selector valve 61 is magnetically controlled by the position of the control lever 69 and the position of switch 66 as previously described with respect to FIG. 2.

To trim down the drive unit 11, the motor 32 and pump 33 are operated while the control lever 69 is in a forward or reverse position so as to deliver hydraulic fluid to and thereby pressurize port 34. The pressure in the shuttle valve assembly 36 effects movement of the shuttle piston 37 to the left to open check valve 39. The pressure in the shuttle valve assembly 36 also causes the check valve 38 to unseat and open communication with the first conduit 46 extending, via the selector valve 61, to the distributor housing 47. The distributor housing 47 communicates the first conduit 46 with flexible conduits 48A and 48B that extend to chambers 26A and 26B respectively of fluid motors 19A and 19B. This will cause pistons 25A and 25B to move to the left to trim down the drive unit 11. The fluid is discharged from chambers 27A and 27B and returns through the open check valve 39 to port 35 so as to provide return fluid for the system.

To trim up the drive unit 11, the system is operated as previously described with reference to trim up operation in FIG. 2.

To operate the hydraulic system in the high speed tilt-up mode in this embodiment, the motor 32 and pump 33 are operated while the control lever is in the neutral position so as to deliver fluid to port 35 and pressurize that port. The hydraulic fluid flows into the shuttle valve assembly 36 to move the shuttle piston 37 to the right causing check valve 38 to open. The pressure in the shuttle valve assembly 36 also causes check valve 39 to unseat and open communication with the second conduit 51. The operation described thus far is the same as the operation for low speed trim-up operation.

At this point the tilting up operation differs from the trimming up operation. In the tilting up operation, the selector valve 61 permits flow of hydraulic fluid from the second conduit 51 to the first conduit 46 through the bypass conduit 64 when it is adjusted to a second position by the control lever 69 and switch 66.

Thus, after entering the second conduit 51, approximately one-half of the hydraulic fluid volume flows through the bypass conduit 64 and selector valve 61 to the first conduit 46 while the other half of the hydraulic fluid volume continues to flow through the second conduit 51. In this arrangement, the pump 33 delivers approximately equal fluid volume to each of the first and second conduits 46 and 51. The distributor housing 47 communicates the first conduit 46 with flexible conduits 48A and 48B which extend to chambers 26A and 26B respectively of the fluid motors 19A and 19B and communicates the second conduit 51 with flexible hoses 49A and 49B which extend to chambers 27A and 27B. When the selector valve 61 is in the second position, the pump 33 delivers fluid pressure to chambers 26A, 26B, 27A and 27B of the fluid motors 19A and 19B simultaneously. Since the pressure receiving cross-sectional area of chambers 27A and 27B is greater than the pressure receiving cross-sectional area of chambers 26A and 26B and since approximately equal pressure is delivered to chambers 26A, 26B, 27A and 27B, a quick outward movement of the piston rods 23A and 23B, and thus a quick tilting-up of the drive unit 11 is achieved.

Figure 4:
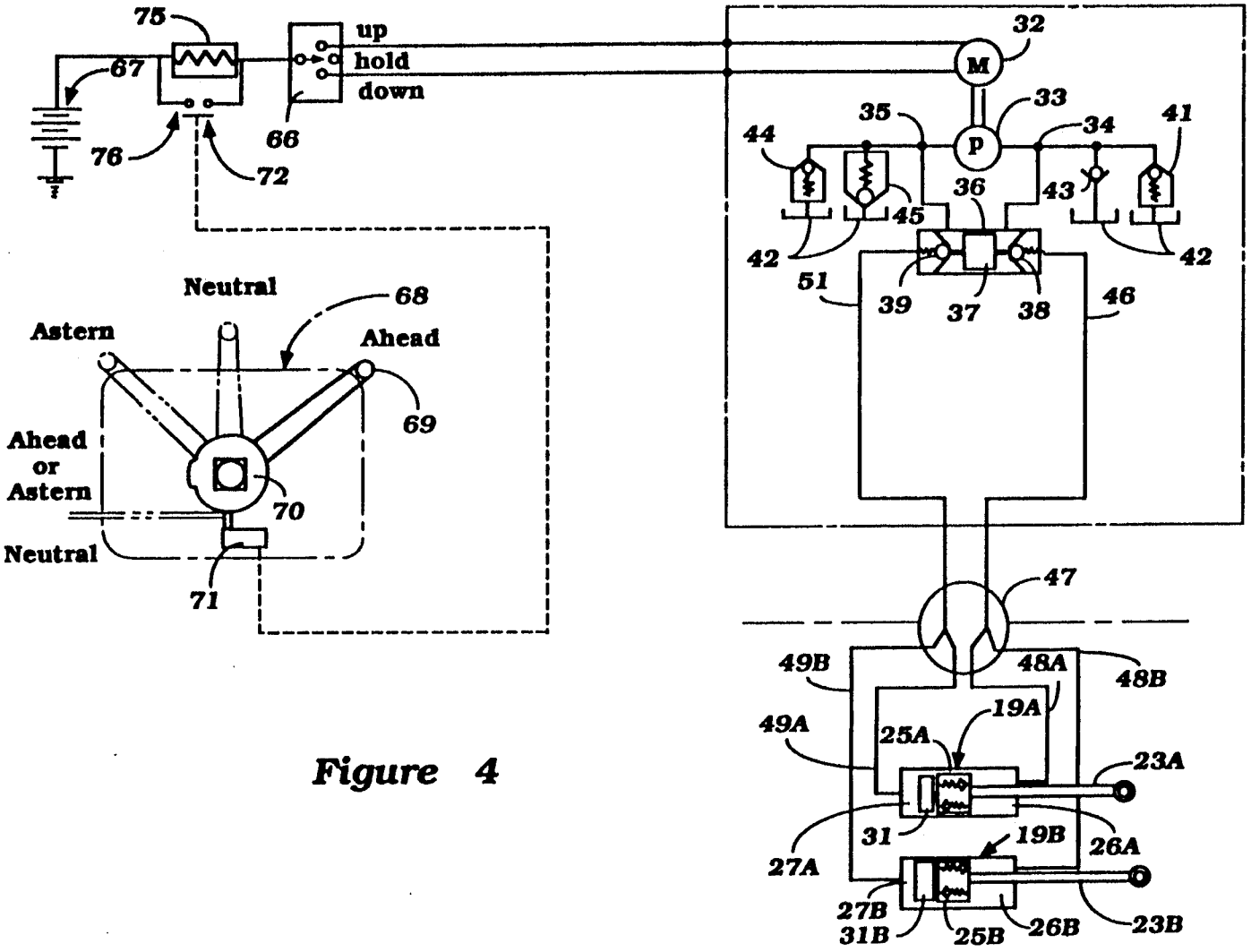
FIG. 4 is a schematic hydraulic circuit diagram showing a third embodiment of the present invention.

FIG. 4 illustrates a third embodiment of the present invention wherein a transformer 75 and bypass circuit 76 are used to control the voltage applied to the motor 32 for effecting quick tilting up of the drive unit 11 or slow trimming of the drive unit 11, instead of a selector valve 61.

The gear-throttle control mechanism 68 is used to control the amount of voltage applied to the motor via the transformer 75 and bypass circuit 76. The control mechanism 68 is linked to the transformer and bypass circuit 76 through the limit switch 71 which has a pair of electrical contacts 72, shown displaced in FIG. 4, for opening and closing the bypass circuit 76. As previously described with respect to movement of the selector valve 61, the position of switch 71 is controlled by the position of the control lever 69. When the control lever 69 is in a forward or reverse position, the switch 71 is released so that the bypass circuit 76 is open as shown in FIG. 4. In this arrangement, the voltage from the battery 67 is "stepped down" or decreased by the transformer 75 before it is applied to the motor 32. As a result, the motor 32 and pump 33 are operated at a lower speed to generate less fluid pressure in the system to achieve slow trimming operation.

To trim up the drive unit 11, the switch 66 is moved to the "up" position to drive the motor 32 so as to pressurize port 35. For trim down operation, the switch 66 is adjusted to the "down" position to drive motor 32 in the opposite direction to pressurize port 34. The "hold" position is used to maintain the drive unit 11 in its present trim adjusted position.

To quickly tilt-up the drive unit 11, the control lever 69 is moved to the neutral position. This causes the cam on casing member 70 to depress switch 71 so that its contacts 72 close the bypass circuit 76. This increases the amount of voltage applied to the motor 32 so that the motor 32 and pump 33 are operated at a higher speed than that used for trimming. As a result, more fluid pressure is generated in the system to effect quick movement of piston rods 23A and 23B and thus quick tilting of the drive unit 11.

The hydraulic fluid flows through the system to effect movement of fluid motors 19A and 19B as previously described with respect to trimming operation in FIG. 2. FIG. 4, however, does not include a selector valve 61 nor does it include a relief valve 52 and manual bypass assembly as previously described with reference to FIG. 2.

Figure 5:
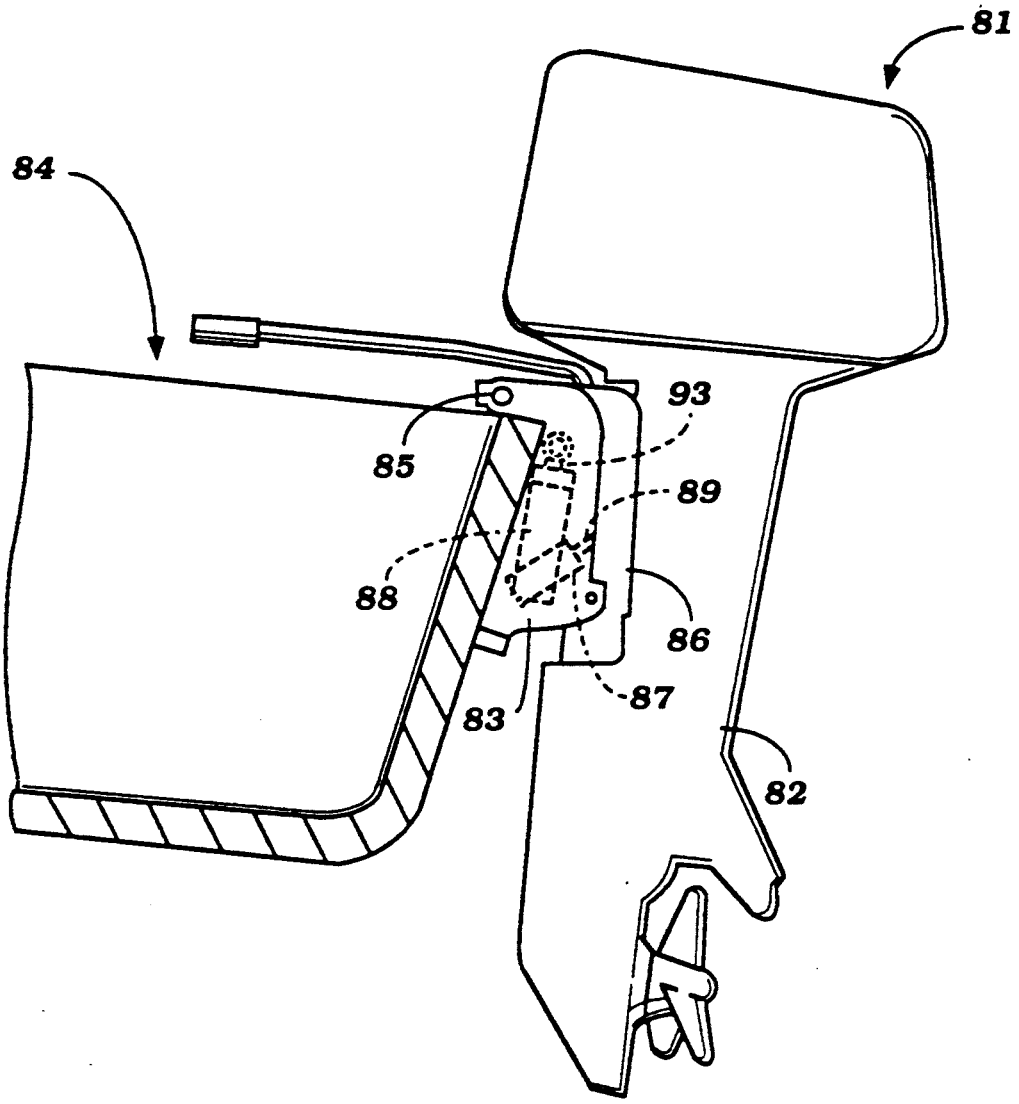
FIG. 5 is a partial side elevational view of a marine vessel having an outboard motor constructed in accordance with embodiments of the invention.

FIG. 5 illustrates a typical outboard motor 81 having a power head including an engine, a drive shaft housing 82 and a lower unit. The lower unit includes a drive shaft (not shown) which is journaled within the lower unit by means of a support bearing (not shown) and is driven at the upper end thereof by the engine.

The motor 81 also includes a clamping bracket 83 attached to the hull of a marine vessel 84, a tilt shaft 85 and a swivel bracket 86 secured at one end to the tilt shaft 85 for movement of the motor 81 between a tilted down position wherein the propeller is positioned beneath the water and a tilted up position wherein the propeller is out of the water. The swivel bracket 86 is secured at the other end to the drive shaft housing for steering movement by a steering tiller.

Trimming up operation is accomplished in this fourth embodiment using a pair of trim fluid motors 87 while tilting up is achieved with a single tilt fluid motor 88. The trim fluid motors 87 each include a piston and piston rod 89 which divide the fluid motors 87 into first and second chambers 91 and 92. Similarly, the tilt fluid motor 88 includes a piston and piston rod 93 which divides the fluid motor 88 into first and second chambers 94 and 95 respectively. The details of this tilting and trimming system are illustrated in FIGS. 6 and 7.

Figure 6:
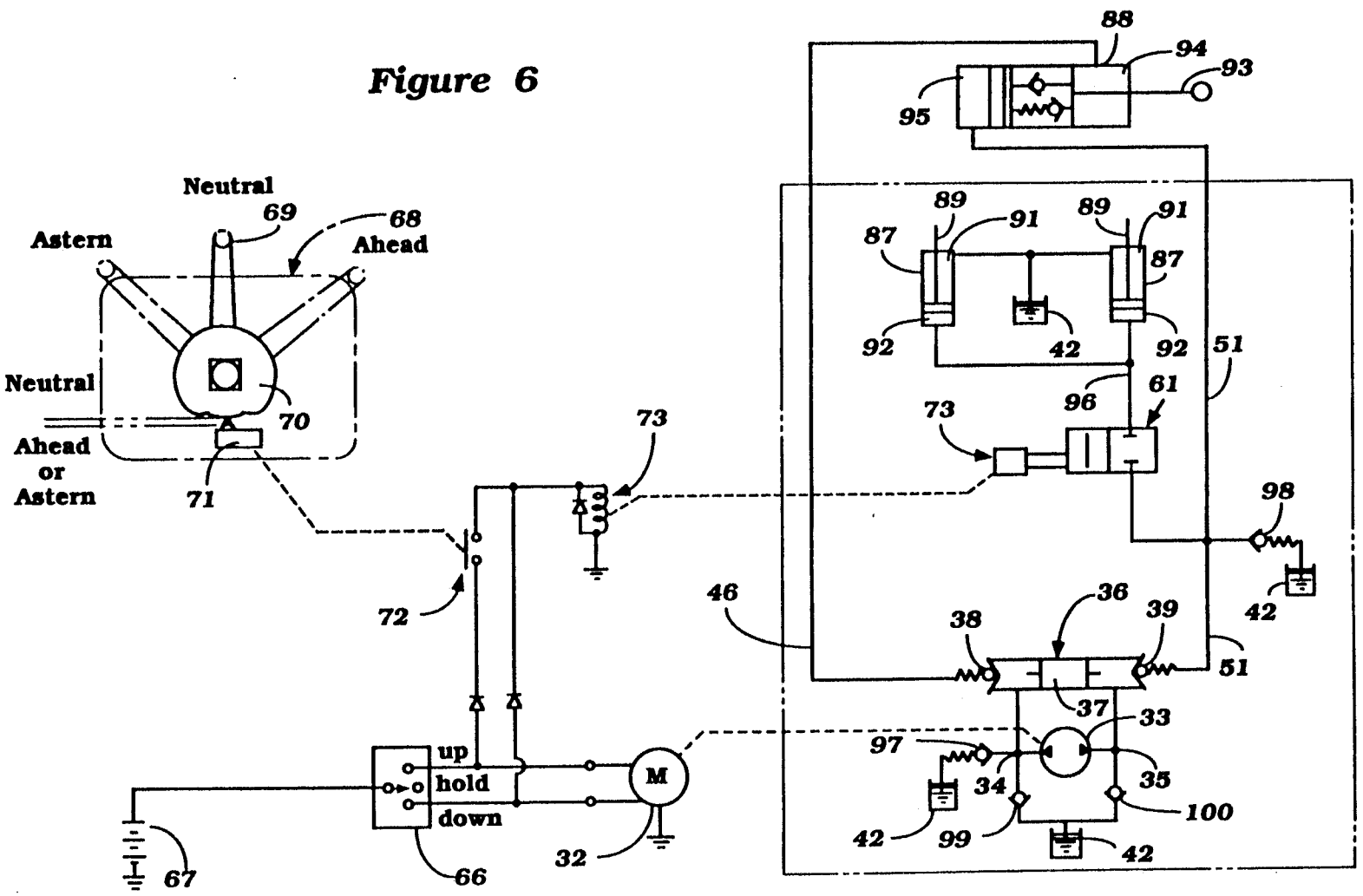
FIG. 6 is a schematic hydraulic circuit diagram showing a fourth embodiment of the present invention.
Figure 7:
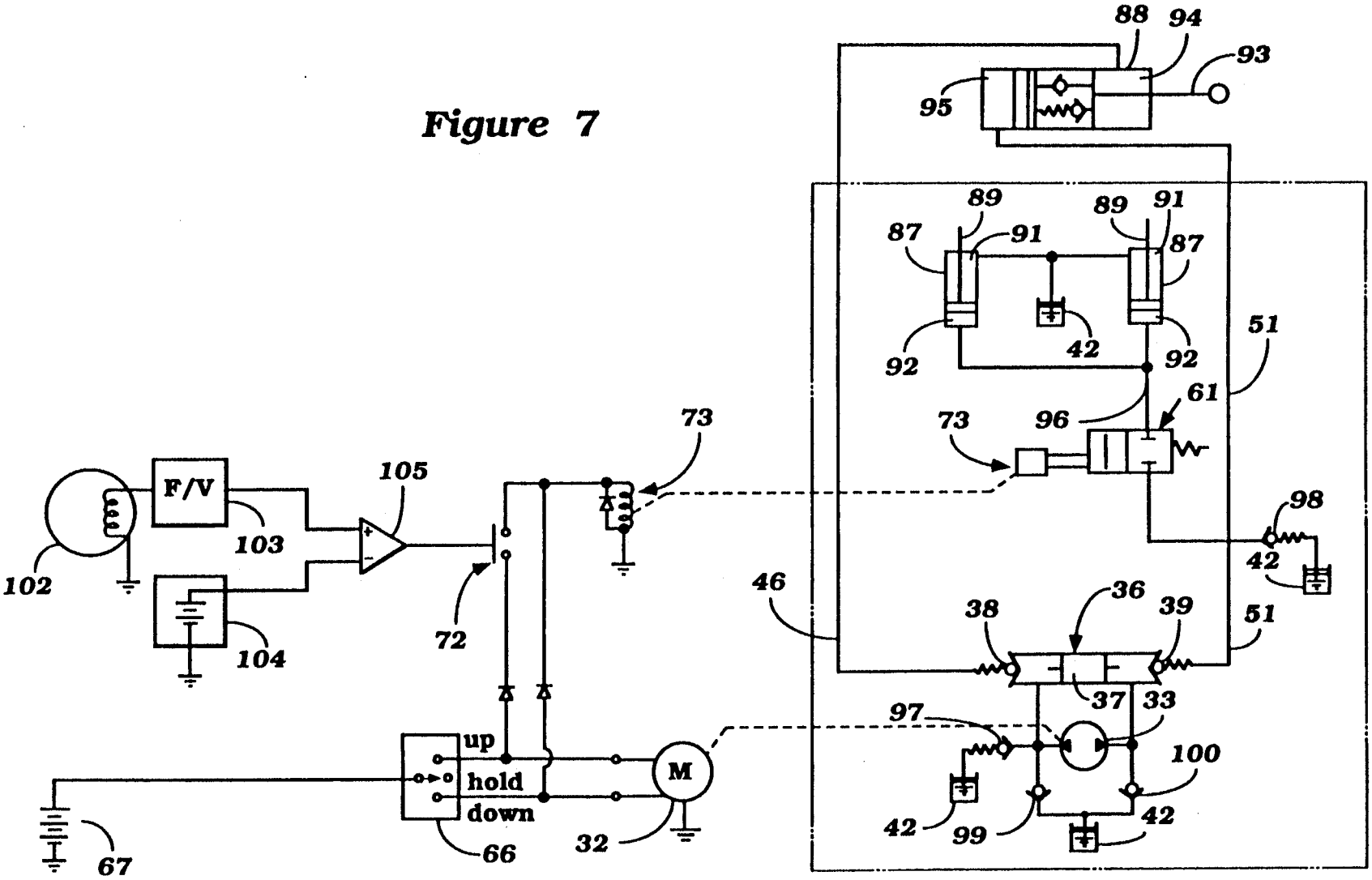
FIG. 7 is a schematic hydraulic circuit diagram showing a fifth embodiment of the present invention.

This system includes a reversible electric motor 32, shown displaced in FIGS. 6 and 7, that drives a reversible fluid pump 33. The ports 34 and 35 communicate with shuttle valve assembly 36. As previously described, this assembly comprises a shuttle piston 37 and a pair of check valves 38 and 39 which are selectively unseated by the projections of the shuttle piston 37 during operation of the system. A pair of pressure responsive relief valves 97 and 98 communicate with the reservoir 42 and permit flow back to the reservoir in the event a high pressure condition exists in the pumping system. Relief valve 98 also permits flow back to the reservoir 42 during trim down operation. A pair of check valves 99 and 100 communicate the reservoir with ports 34 and 35 respectively permitting return flow to the system for make up purposes.

In the fourth embodiment the gear throttle control mechanism 68 and switch 66 are used to adjust the position of the magnetically operated selector valve 61 to achieve tilting and trimming operation. Movement of the control lever 69 between the forward, reverse and neutral positions effects movement of the selector valve 61 as hereinafter described.

When the control lever 69 is in the neutral position, a recess on casing member 70 releases switch 71 so that the circuit between the switch 66 in the "up" position and the selector valve 61 is open, as shown in FIG. 6. When the control lever 69 is in the neutral position, the selector valve is in its second or tilted adjusted position.

To quickly tilt up the drive unit 11, the switch 66 is moved to the "up" position driving the motor 32 and pump 33 so as to pressurize port 35. Hydraulic fluid flows into the shuttle valve assembly 36 causing the shuttle piston 37 to move to the left which causes check valve 38 to open. The pressure in the shuttle valve assembly 36 also unseats check valve 39 opening communication with the second conduit 51. Hydraulic fluid is then delivered to chamber 95 of the tilt fluid motor 88 causing a rapid outward movement of the piston and piston rod 93 to quickly tilt up the drive unit 11. During this operation fluid is discharged from chamber 94 through first conduit 46. The fluid returns through open check valve 38 to port 34 so as to provide return fluid for the system. The piston rods 89 of trim fluid motors 87 also extend during tilt up operation, causing the fluid in chambers 91 to drain into the reservoir 42.

To tilt down the drive unit 11, the switch 66 is adjusted to the "down" position. This drives the motor 32 and pump 33 in the opposite direction to pressurize port 34. This also causes the selector valve 61 to move to the right, opening communication between the second conduit 51 and the trim fluid motors 87 so that the fluid in chambers 92 can drain into the reservoir 42 in response to contraction of fluid motor 88 as hereinafter described.

Pressurizing port 34 effects movement of the shuttle piston 37 to the right opening check valve 39 so that port 35 acts as a return port. The fluid pressure in the shuttle valve assembly 36 opens check valve 38, flows through first conduit 46 to pressurize chamber 94 of the tilt fluid motor 88 to cause tilt down movement.

When the control lever 69 is in a forward or reverse position, the casing member 70 depresses switch 71 so that its electrical contacts 72 close the circuit between the switch 66 in the "up" position and the selector valve 61. This actuates the solenoid winding 73 causing the selector valve 61 to open communication between the second conduit 51 and trim fluid motors 87 when switch 66 is positioned in either the "up" or "down+ position.

To slowly trim up the drive unit 11 switch 66 is moved to the "up" position while control lever 69 is in a forward or reverse position so that port 35 is pressurized by the motor 32 and pump 33. Hydraulic fluid flows through shuttle valve assembly 36 as previously described and into second conduit 51. During this operation, approximately one-half of the fluid volume is fed into a bypass conduit 96 and then into chambers 92 of fluid motors 87. The other half of the fluid volume is delivered to chamber 95 of fluid motor 88. This causes slow trimming up of the drive unit 11 as the piston rods 89 and 93 extend outward. Fluid from chamber 94 fluid motor 88 is discharged through first conduit 46 and back to port 34 so as to provide return fluid for the system. Fluid from chambers 91 drains into reservoir 42 in response to expansion fluid motors 87.

To trim down the drive unit 11, the switch 66 is moved to the "down" position so that fluid is delivered through port 34 and into chamber 94 of fluid motor 88. Fluid from chamber 95 is discharged into second conduit 51 while fluid from chambers 92 is discharged into the bypass conduit 96 in response to contraction of the fluid motors 87 and 88. The pressure conduits 51 and 96 causes relief valve 98 to open so that the fluid can drain into reservoir 42.

FIG. 7 illustrates a fifth embodiment of the invention and differs from FIG. 6 only in that the position of the selector valve 61 is linked to the engine speed and switch 66 rather than the gear throttle control mechanism 68 and switch 66. This embodiment includes an AC generator 102 operably connected to the engine of the drive unit by a belt or other suitable means. The output of the AC generator 102 is connected to the input terminal of a frequently/voltage (F/V) converter 103. The F/V converter 103 converts the frequency of the AC generator 102 (which is proportional to the engine speed) to voltage so that the output voltage increased when engine speed increases. A reference voltage generator 104 is provided which generates a predetermined amount of voltage. The output of the F/V converter 103 and reference generator 104 are electrically linked to a comparator 105 for comparing the output voltage of the F/V converter 103 and the voltage generated by the reference generator 104. When the voltage output of the F/V converter 103 is greater than the voltage of reference generator 104, the electrical contacts 72 which are operably connected to the comparator 105, close the circuit between switch 66 and selector valve 61, causing the selector valve 61 to move to its first position, opening communication between second conduit 51 and trim fluid motors 87 when switch 66 is positioned in either the "up" or "down" position. The system is now arranged for slow trimming of the drive unit 11.

When the voltage output of F/V converter 103 is less than the voltage of reference generator 104, the circuit between switch 66 and selector valve 61 is open so that the selector valve 61 is in its second position wherein communication between conduit 51 and trim fluid motors 87 is closed when switch 66 is in the "up" position. The system is now arranged for quick tilting-up of the drive unit 11.

Although it is possible to use the main generator, it is best to use a separate generator or alternator for the control. If the output voltage of the main generator or alternator of the engine is used the output varies not only with the engine speed but with other loads connected to the main generator as well.

In the case of using a separate generator or alternator the output voltage of which increases in response to an increase in engine speed, it is possible to compare a rectified and averaged output voltage of the generator or alternator directly with the reference voltage.

Although several embodiments of the invention have been described, various changes or modifications may be made in the embodiments without departing from the spirit and scope of the invention as defined by the appended claims.

I claim:

1. In a hydraulic tilt and trim system for an outboard drive unit mounted on the transom of a marine vessel for tilting movement of the drive unit and movement between a plurality of trim positions, comprising at least one fluid motor connected to said drive unit and said transom, said fluid motor having a cylinder housing and a moveable member defining a pair of fluid chambers, a pump for delivering hydraulic fluid to said fluid motor, and an electric motor for driving said pump, the improvement comprising means for controlling the voltage applied to said motor for selectively effecting quick tilting up movement of the drive unit and slow trimming movement of the drive unit between a plurality of trim positions.

2. In a hydraulic tilt and trim system as recited in claim 1, wherein said voltage controlling means further comprises a transformer for changing the voltage applied to said motor.

3. In a hydraulic tilt and trim system as recited in claim 2, wherein said voltage controlling means further comprises a bypass circuit and a limit switch for opening and closing said bypass circuit, the amount of voltage being applied to said electric motor being greater when said bypass circuit is closed than when said bypass circuit is open.

4. In a hydraulic tilt and trim system as recited in claim 3, wherein said voltage controlling means further comprises a gear-throttle control mechanism moveable between a plurality of forward and reverse positions and a neutral position, said gear-throttle control mechanism having a cam member for depressing said limit switch for closing said bypass circuit when said gear-throttle control mechanism is in the neutral position.

5. In a hydraulic tilt and trim system for an outboard drive unit having an engine and mounted on a transom of a marine vessel for tilting movement of the drive unit and movement between a plurality of trim positions, comprising first, second and third fluid motors, each connected to said drive unit and said transom, said fluid motors having cylinder housings and moveable members defining first and second fluid chambers in each fluid motor, a pump for delivering hydraulic fluid to said fluid motors, and a magnetically operated selector valve adjustable between a first position wherein said pump delivers hydraulic fluid to one of said fluid chambers of each of said fluid motors to slowly trim up the drive unit and a second position wherein said pump delivers fluid to only one of said chambers of one of said fluid motors only, the fluid in the other chamber of said fluid motor being discharged to said pump in response to the movement of said moveable member of said fluid motor to quickly tilt up the drive unit, said tile and trim system further comprising means for controlling the position of said selector valve including a control mechanism for controlling the gear position of said outboard drive unit, a manual switch for operating said pump, and a limit switch, wherein the position of the selector valve is controlled by said switch and the gear position of said outboard drive unit, said limit switch being actuated when said outboard drive unit is in the forward or reverse gear position to adjust said selector valve to the first position when said pump is operated by said manual switch.

6. In a hydraulic tilt and trim system as recited in claim 5, wherein said control mechanism comprises a gear-throttle mechanism having a control lever moveable between a plurality of forward and reverse positions and a neutral position for controlling the gear position of said drive unit.

7. In a hydraulic tilt and trim system as recited in claim 6, wherein said limit switch is actuated when said control lever is in a forward or reverse position to adjust said selector valve to the first position when said pump is operated by said manual switch.

8. In a hydraulic tilt and trim system for an outboard drive unit having an engine and mounted on a transom of a marine vessel for tilting movement of the drive unit and movement between a plurality of trim positions, comprising first, second and third fluid motors, each connected to said drive unit and said transom, said fluid motors having cylinder housings and moveable members defining first and second fluid chambers in each fluid motor, a pump for delivering hydraulic fluid to said fluid motors, and a magnetically operated selector valve adjustable between a first position wherein said pump delivers hydraulic fluid to one of said fluid chambers of each of said fluid motors to slowly trim up the drive unit and a second position wherein said pump delivers fluid to only one of said chambers of one of said fluid motors only, the fluid in the other chamber of said fluid motor being discharged to said pump in response to the movement of said moveable member of said fluid motor to quickly tilt up the drive unit, said tilt and trim system further comprising means for controlling the position of said selector valve including an AC generator operably connected to the engine of said drive unit, a frequency/voltage converter for converting the frequency of said AC generator to voltage, a reference generator, and means for comparing the output voltage of said converter and the voltage generated by said reference generator.

9. In a hydraulic tilt and trim system as recited in claim 8, wherein said comparing means comprises a comparator.

10. In a hydraulic tilt and trim system as recited in claim 9, wherein said selector valve is in said first position when the voltage output of said converter is greater than the voltage of said reference generator.

11. In a hydraulic tilt and trim system as recited in claim 10, wherein said selector valve is in said second position when the voltage output of said converter is less than the voltage of said reference generator.

* * * * *